United States Patent [19]

Robinette et al.

[11] Patent Number: 5,069,993

[45] Date of Patent: Dec. 3, 1991

[54] PHOTORECEPTOR LAYERS CONTAINING POLYDIMETHYLSILOXANE COPOLYMERS

[75] Inventors: Susan Robinette, Pittsford; Joseph Mammino, Penfield; Kathleen M. Carmichael, Williamson; Emery G. Tokoli, Rochester; Anita P. Lynch; Robert C. U. Yu, both of Webster, all of N.Y.

[73] Assignee: Xerox Corporation, Stamford, Conn.

[21] Appl. No.: 459,337

[22] Filed: Dec. 29, 1989

[51] Int. Cl.[5] ..... G03G 5/04

[52] U.S. Cl. ..... 430/58; 430/59; 430/66

[58] Field of Search ..... 430/58, 59, 78, 79, 430/83, 96, 66

[56] References Cited

U.S. PATENT DOCUMENTS

| | | | |
|---|---|---|---|
| 3,121,006 | 2/1964 | Middleton et al. | 96/1 |
| 3,357,989 | 12/1967 | Byrne et al. | 260/314.5 |
| 3,442,781 | 5/1969 | Weinberger | 204/181 |
| 3,885,965 | 5/1975 | Hughes et al. | 96/48 |
| 4,078,927 | 3/1978 | Amidon et al. | 96/1 |
| 4,078,935 | 3/1978 | Nakagirl et al. | 96/87 A |
| 4,218,514 | 8/1980 | Pacansky et al. | 428/450 |
| 4,254,208 | 3/1981 | Tatsuta et al. | 430/215 |
| 4,265,990 | 5/1981 | Stolka et al. | 430/59 |
| 4,286,033 | 8/1981 | Neyhart et al. | 430/58 |
| 4,291,110 | 9/1981 | Lee | 430/59 |
| 4,332,715 | 6/1982 | Ona et al. | 524/265 |
| 4,338,387 | 7/1982 | Hewitt | 430/58 |
| 4,340,658 | 7/1982 | Inoue et al. | 430/58 |
| 4,388,392 | 6/1983 | Kato et al. | 430/58 |
| 4,415,639 | 11/1983 | Horgan | 430/57 |
| 4,469,769 | 9/1984 | Nakazawa et al. | 430/78 |
| 4,496,642 | 1/1985 | Tam et al. | 430/41 |
| 4,515,882 | 5/1985 | Mammino et al. | 430/58 |
| 4,519,698 | 5/1985 | Kohyama et al. | 355/15 |
| 4,664,995 | 5/1987 | Horgan et al. | 430/59 |
| 4,689,289 | 8/1987 | Crivello | 430/270 |
| 4,738,950 | 4/1988 | Vanier et al. | 503/227 |
| 4,784,928 | 11/1988 | Kan et al. | 430/58 |
| 4,807,341 | 2/1989 | Nielsen et al. | 29/132 |

*Primary Examiner*—John Goodrow
*Attorney, Agent, or Firm*—Oliff & Berridge

[57] ABSTRACT

An exposed layer in an electrophotographic imaging member is provided with increased resistance to stress cracking and reduced coefficient of surface friction, without adverse effects on optical clarity and electrical performance. The layer contains a polydimethylsiloxane copolymer and an inactive film forming resin binder.

18 Claims, 1 Drawing Sheet

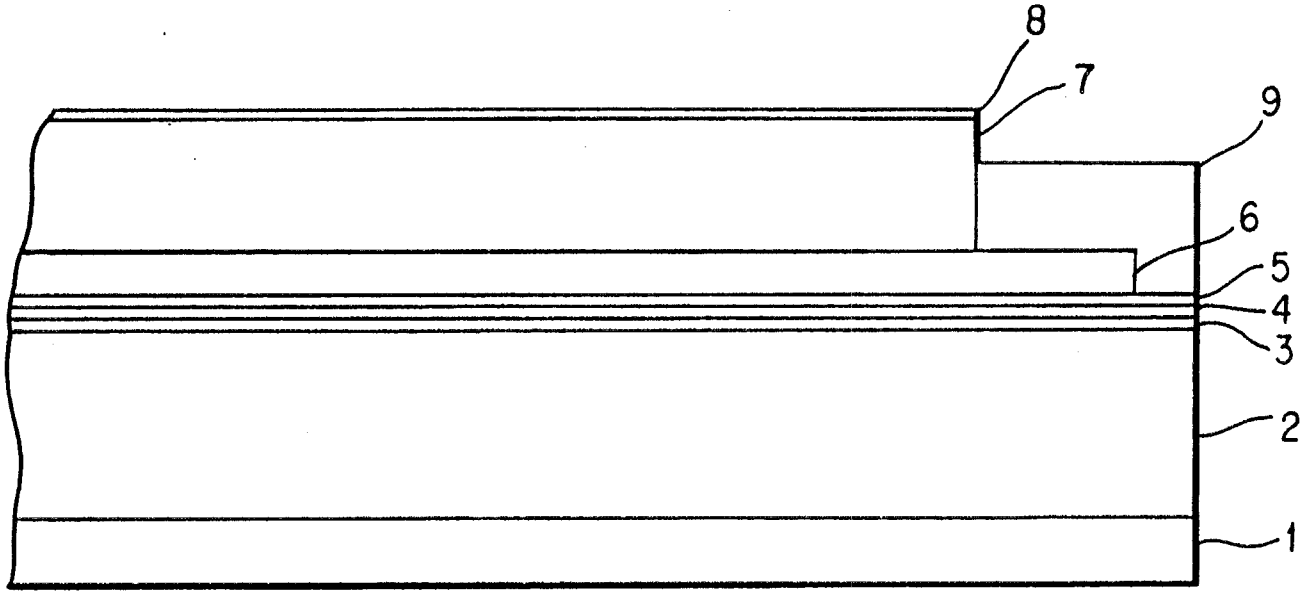
8
7
9
6
5
4
3
2
1

PHOTORECEPTOR LAYERS CONTAINING POLYDIMETHYLSILOXANE COPOLYMERS

BACKGROUND OF THE INVENTION

This invention relates in general to electrophotography and, in particular, to an electrophotoconductive imaging member having an exposed layer having a reduced coefficient of surface friction and enhanced elongation.

In electrophotography, an electrophotographic plate containing a photoconductive insulating layer on a conductive layer is imaged by first uniformly electrostatically charging its surface. The plate is then exposed to a pattern of activating electromagnetic radiation such as light. The radiation selectively dissipates the charge in the illuminated areas of the photoconductive insulating layer while leaving behind an electrostatic latent image in the non-illuminated areas. This electrostatic latent image may then be developed to form a visible image by depositing finely divided electroscopic marking particles on the surface of the photoconductive insulating layer. The resulting visible image may then be transferred from the electrophotographic plate to a support such as paper. This imaging process may be repeated many times with reusable photoconductive insulating layers.

An electrophotographic imaging member may be provided in a number of forms. For example, the imaging member may be a homogeneous layer of a single material such as vitreous selenium or it may be a composite layer containing a photoconductor and another material. One type of composite imaging member comprises a layer of finely divided particles of a photoconductive inorganic compound dispersed in an electrically insulating organic resin binder. U.S. Pat. No. 4,265,990 discloses a layered photoreceptor having separate photogenerating and charge transport layers. The photogenerating layer is capable of photogenerating holes and injecting the photogenerated holes into the charge transport layer.

Other composite imaging members have been developed having numerous layers which are highly flexible and exhibit predictable electrical characteristics within narrow operating limits to provide excellent images over many thousands of cycles. One type of multilayered photoreceptor that has been employed as a belt in electrophotographic imaging systems comprises a substrate, a conductive layer, a blocking layer, an adhesive layer, a charge generating layer, a charge transport layer and a conductive ground strip layer adjacent to one edge of the imaging layers. This photoreceptor may also comprise additional optional layers such as an anti-curl back coating and an overcoating layer.

Imaging members are generally exposed to repetitive electrophotographic cycling which subjects exposed layers thereof to abrasion, chemical attack, heat and multiple exposures to light. This repetitive cycling leads to a gradual deterioration in the mechanical and electrical characteristics of the exposed layers. For example, repetitive cycling has adverse effects on exposed portions of the imaging member, such as the ground strip, charge transport layer, substrate and/or anti-curl layer. Attempts have been made to overcome these problems. However, the solution of one problem often leads to additional problems.

If a relatively great frictional force acts between the photosensitive member and a cleaning member, the surface of the photosensitive member may be damaged, and wear off or filming of the toner may result due to the high surface contact friction between the cleaning device and the charge transport layer of the photosensitive member. Wear caused by high frictional force during machine function may reduce the thickness of the charge transport layer. This reduction in charge transport layer thickness increases the electrical field across the layer, and alters electrophotographic performance. Moreover, static electricity generated by friction results in nonuniform surface potential in the charging step, which in turn causes irregular image formation or fogging. In order to reduce the frictional force, the pressure of the cleaning member, e.g., a cleaning blade, may be reduced. However, by reducing the frictional force, the cleaning blade may not be able to clean the photosensitive member sufficiently, resulting in toner build-up or surface filming. Even with a reduced cleaning blade force against the imaging member, the cleaning blade and imaging member tend to stick together, especially when first operating the device after a period of nonuse.

Other attempts at reducing the frictional force acting between the cleaning blade and the photosensitive member include adding a lubricant such as wax to the toner. However, the fixability of the toner may degrade its electrical function, or further filming may occur, resulting in a degraded image.

A proposal for reducing frictional force involves applying a lubricant on the surface of the photosensitive drum. U.S. Pat. No. 4,519,698 to Kohyama et al discloses a waxy lubricant method to constantly lubricate a cleaning blade. However, the thickness of the lubricant film formed on the photosensitive drum is difficult to maintain, and interference with the electrostatic characteristics of the photosensitive member occurs. Attempts have also been made to construct a cleaning blade with a material having a low coefficient of friction. However, these attempts are subject to the problem of degradation in other characteristics, especially mechanical strength, due to the presence of additives.

According to U.S. Pat. No. 4,340,658 to Inoue et al and U.S. Pat. No. 4,388,392 to Kato et al, surface smoothness of a photosensitive layer may be improved by addition of a levelling agent such as polydimethylsiloxane to a polyvinyl carbazole type photoconductor.

Another problem in multilayered belt imaging systems includes cracking in one or more critical imaging layers during belt cycling over small diameter rollers. Cracks developed in the charge transport layer during cycling are a frequent phenomenon and most problematic because they can manifest themselves as print-out defects which adversely affect copy quality. Charge transport layer cracking has a serious impact on the versatility of a photoreceptor and reduces its practical value.

When one or more photoconductive layers are applied to a flexible supporting substrate, it has been found that the resulting photoconductive member tends to curl. Coatings may be applied to the side of the supporting substrate opposite the photoconductive layer(s) to counteract the tendency to curl. However, difficulties have been encountered with these anti-curl coatings. For example, photoreceptor curl can sometimes still be encountered in as few as 1,500 imaging cycles under the stressful conditions of high temperature and high humidity. Further, it has been found that during cycling of the photoconductive imaging member in electrophotographic imaging systems, the relatively rapid wear of the anti-curl coating also results in the curling of the photoconductive imaging member. In some tests, the anti-curl coating was completely removed in 150,000 to 200,000 cycles. This wear problem is even more pronounced when photoconductive imaging members in the form of webs or belts are supported in part by stationary guide surfaces which cause the anti-curl layer to wear away very rapidly and produce debris which scatters and deposits on critical machine components such as lenses, corona charging devices and the like, thereby adversely affecting machine performance. Also, the anti-curl coatings occasionally separate from the substrate during extended cycling and render the photoconductive imaging member unacceptable for forming quality images. It has also been found that when long webs of a flexible photoconductor having an anti-curl coating on one side of a supporting substrate and a photoconductive layer on the opposite side of the substrate are rolled into large rolls, dimples and creases form on the photoconductive layer which result in print defects in the final developed images. Further, when the webs are formed into belts, segments of the outer surface of the anti-curl layer in contact with each other during shipment or storage at elevated temperatures also cause creases and dimples to form which are seen as undesirable aberrations in the final printed images. Expensive and elaborate packaging is necessary to prevent the anti-curl coating from contacting itself Further, difficulties have been encountered in continuous coating machines during the winter manufacturing of the coated photoconductive imaging members because of occasional seizing which prevents transport of the coated web through the machine for downstream processing.

Thus, it is desirable to increase the durability and extend the life of exposed surfaces in an imaging device as well as to reduce frictional contact between members of the imaging device while maintaining electrical and mechanical integrity.

SUMMARY OF THE INVENTION

It is an object of the invention to reduce wear and increase durability of exposed layers in a photosensitive device.

It is also an object of the invention to reduce frictional contact between contacting members in an imaging device.

It is another object of the invention to provide an electrophotographic imaging member having improved wear resistance of the exposed layers, and to maintain the optical, mechanical and electrical integrity of the layers.

It is yet another object of the invention to provide an electrophotographic imaging member with improved charge transport layer resistance to tensile stress cracking.

The present invention overcomes the shortcomings of the prior art by providing a layer in an imaging member comprising a film-forming binder and a polydimethylsiloxane copolymer. The addition of a polydimethylsiloxane copolymer reduces the coefficient of surface friction and improves resistance to stress cracking without adverse effects on electrical performance. The invention is particularly applicable to an exposed charge transport layer, as well as to anti-curl layers.

BRIEF DESCRIPTION OF THE DRAWINGS

A more complete understanding of the present invention can be obtained by reference to the accompanying Figure which is a cross-sectional view of a multilayer photoreceptor of the invention.

DESCRIPTION OF PREFERRED EMBODIMENTS

The electrophotographic imaging member according to the present invention contains at least one layer which includes a film forming binder and a polydimethylsiloxane (PDMS) copolymer. Addition of the PDMS copolymer reduces the coefficient of surface friction of the layer and improves resistance of the layer to stress cracking by increasing percent elongation. Wear effects are reduced and electrical properties are not affected.

A representative structure of an electrophotographic imaging member is shown in the Figure. This imaging member is provided with an anti-curl back coating 1, a supporting substrate 2, an electrically conductive ground plane 3, a hole blocking layer 4, an adhesive layer 5, a charge generating layer 6, and a charge transport layer 7. Optional overcoating layer 8 and ground strip 9 are also shown in the figure.

The Supporting Substrate

The supporting substrate 2 may be opaque or substantially transparent and may comprise numerous suitable materials having the required mechanical properties. The substrate may further be provided with an electrically conductive surface. Accordingly, the substrate may comprise a layer of an electrically non-conductive or conductive material such as an inorganic or an organic composition. As electrically non-conducting materials, there may be employed various resin binders known for this purpose including polyesters, polycarbonates such as bisphenol polycarbonates, polyamides, polyurethanes, polystyrenes and the like. The electrically insulating or conductive substrate should be flexible and may have any number of different configurations such as, for example, a sheet, a scroll, an endless flexible belt, and the like. Preferably, the substrate is in the form of an endless flexible belt and comprises a commercially available biaxially oriented polyester known as Mylar, available from E. I. du Pont de Nemours & Co., or Melinex, available from ICI Americas Inc.

The thickness of the substrate layer depends on numerous factors, including mechanical performance and economic considerations. The thickness of this layer may range from about 65 micrometers to about 150 micrometers, and preferably from about 75 micrometers to about 125 micrometers for optimum flexibility and minimum induced surface bending stress when cycled around small diameter rollers, e.g., 19 millimeter diameter rollers. The substrate for a flexible belt may be of substantial thickness, for example, over 200 micrometers, or of minimum thickness, for example less than 50 micrometers, provided there are no adverse effects on the final photoconductive device. The surface of the substrate layer is preferably cleaned prior to coating to promote greater adhesion of the deposited coating. Cleaning may be effected by exposing the surface of the substrate layer to plasma discharge, ion bombardment, solvent cleaning, and other suitable techniques.

The Electrically Conductive Ground Plane

The electrically conductive ground plane 3 may be an electrically conductive metal layer which may be formed, for example, on the substrate 2 by any suitable coating technique, such as a vacuum depositing technique. Typical metals include aluminum, zirconium, niobium, tantalum, vanadium, hafnium, titanium, nickel, stainless steel, chromium, tungsten, molybdenum, and other conductive substances, and mixtures thereof. The conductive layer may vary in thickness over substantially wide ranges depending on the optical transparency and flexibility desired for the electrophotoconductive member. Accordingly, for a flexible photoresponsive imaging device, the thickness of the conductive layer may be between about 20 Angstroms to about 750 Angstroms, and more preferably from about 50 Angstroms to about 200 Angstroms for an optimum combination of electrical conductivity, flexibility and light transmission.

Regardless of the technique employed to form the metal layer, a thin layer of metal oxide forms on the outer surface of most metals upon exposure to air. Thus, when other layers overlying the metal layer are characterized as "contiguous" layers, it is intended that these overlying contiguous layers may, in fact, contact a thin metal oxide layer that has formed on the outer surface of the oxidizable metal layer. Generally, for rear erase exposure, a conductive layer light transparency of at least about 15 percent is desirable. The conductive layer need not be limited to metals. Other examples of conductive layers may be combinations of materials such as conductive indium tin oxide as transparent layer for light having a wavelength between about 4000 Angstroms and about 9000 Angstroms or a conductive carbon black dispersed in a polymeric binder as an opaque conductive layer.

The Hole Blocking Layer

After deposition of the electrically conductive ground plane layer, the hole blocking layer 4 may be applied thereto. Electron blocking layers for positively charged photoreceptors allow holes from the imaging surface of the photoreceptor to migrate toward the conductive layer. For negatively charged photoreceptors, any suitable hole blocking layer capable of forming a barrier to prevent hole injection from the conductive layer to the opposite photoconductive layer may be utilized. The hole blocking layer may include polymers such as polyvinylbutryral, epoxy resins, polyesters, polysiloxanes, polyamides, polyurethanes and the like, or may be nitrogen containing siloxanes or nitrogen containing titanium compounds such as trimethoxysilyl propylene diamine, hydrolyzed trimethoxysilyl propyl ethylene diamine, N-beta-(aminoethyl) gamma-aminopropyl trimethoxy silane, isopropyl 4-aminobenzene sulfonyl, di(dodecylbenzene sulfonyl) titanate, isopropyl di(4-aminobenzoyl)isostearoyl titanate, isopropyl tri(N-ethylamino-ethylamino)titanate, isopropyl trianthranil titanate, isopropyl tri(N,N-dimethylethylamino)titanate, titanium-4-amino benzene sulfonate oxyacetate, titanium 4-aminobenzoate isostearate oxyacetate, $[H_2N(CH_2)_4]CH_3Si(OCH_3)_2$, (gamma-aminobutyl) methyl diethoxysilane, and $[H_2N(CH_2)_3]CH_3Si(OCH_3)_2$ (gamma-aminopropyl) methyl diethoxysilane, as disclosed in U.S. Pat. Nos. 4,338,387, 4,286,033 and 4,291,110. A preferred hole blocking layer comprises a reaction product between a hydrolyzed silane or mixture of hydrolized silanes and the oxidized surface of a metal ground plane layer. The oxidized surface inherently forms on the outer surface of most metal ground plane layers when exposed to air after deposition. This combination enhances electrical stability at low RH. The hydrolyzed silanes have the general formula

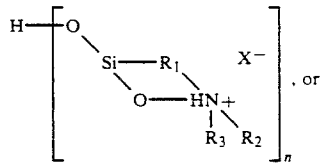

I

, or

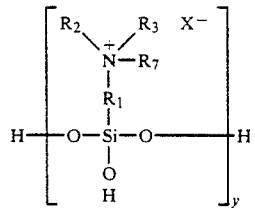

II wherein $R_1$ is an alkylidene group containing 1 to 20 carbon atoms, $R_2$, $R_3$ and $R_7$ are independently selected from the group consisting of H, a lower alkyl group containing 1 to 3 carbon atoms and a phenyl group, X is an anion of an acid or acidic salt, n is 1–4, and y is 1–4. The imaging member is preferably prepared by depositing on the metal oxide layer of a metal conductive layer, a coating of an aqueous solution of the hydrolyzed aminosilane at a pH between about 4 and about 10, drying the reaction product layer to form a siloxane film and applying an adhesive layer, and thereafter applying electrically operative layers, such as a photogenerator layer and a hole transport layer, to the adhesive layer.

The hole blocking layer should be continuous and have a thickness of less than about 0.5 micrometer because greater thicknesses may lead to undesirably high residual voltage. A hole blocking layer of between about 0.005 micrometer and about 0.3 micrometer is preferred because charge neutralization after the exposure step is facilitated and optimum electrical performance is achieved. A thickness of between about 0.03 micrometer and about 0.06 micrometer is preferred for hole blocking layers for optimum electrical behavior. The blocking layer may be applied by any suitable conventional technique such as spraying, dip coating, draw bar coating, gravure coating, silk screening, air knife coating, reverse roll coating, vacuum deposition, chemical treatment and the like. For convenience in obtaining thin layers, the blocking layer is preferably applied in the form of a dilute solution, with the solvent being removed after deposition of the coating by conventional techniques such as by vacuum, heating and the like. Generally, a weight ratio of hole blocking layer material and solvent of between about 0.05:100 to about 0.5:100 is satisfactory for spray coating.

The Adhesive Layer

In most cases, intermediate layers between the injection blocking layer and the adjacent charge generating or photogenerating layer may be desired to promote adhesion. For example, the adhesive layer 5 may be employed. If such layers are utilized, they preferably have a dry thickness between about 0.001 micrometer to about 0.2 micrometer. Typical adhesive layers include film-forming polymers such as copolyester, du Pont 49,000 resin (available from E. I. du Pont de Nemours & Co.), Vitel-PE100 (available from Goodyear Rubber & Tire Co.), polyvinylbutyral, polyvinylpyrolidone, polyurethane, polymethyl methacrylate, and the like.

The Charge Generating Layer

Any suitable charge generating (photogenerating) layer 6 may be applied to the adhesive layer 5 which can then be coated over with a contiguous hole tranport layer as described. Examples of materials for photogenerating layers include inorganic photoconductive particles such as amorphous selenium, trigonal selenium, and selenium alloys selected from the group consisting of selenium-tellurium, selenium-tellurium-arsenic, selenium arsenide and phthalocyanine pigment such as the X-form of metal free phthalocyanine described in U.S. Pat. No. 3,357,989, metal phthalocyanines such as vanadyl phthalocyanine and copper phthalocyanine, dibromoanthanthrone, squarylium pigments and dyes, quinacridones available from du Pont under the tradename Monastral Red, Monastral Violet and Monastral Red Y, Vat orange 1 and Vat orange 3 trade names for dibromo anthanthrone pigments, benzimidazole perylene, substituted 2,4-diamino-triazines disclosed in U.S. Pat. No. 3,442,781, polynuclear aromatic quinones available from Allied Chemical Corporation under the tradename Indofast Double Scarlet, Indofast Violet Lake B, Indofast Brilliant Scarlet and Indofast Orange, and the like, dispersed in a film forming polymeric binder. Multi-photogenerating layer compositions may be utilized where a photoconductive layer enhances or reduces the properties of the photogenerating layer. Examples of this type of configuration are described in U.S. Pat. No. 4,415,639. Other suitable photogenerating materials known in the art may also be utilized, if desired. Charge generating layers comprising a photoconductive material such as vanadyl phthalocyanine, metal free phthalocyanine, benzimidazole perylene, amorphous selenium, trigonal selenium, selenium alloys such as selenium-tellurium, selenium-tellurium-arsenic, selenium arsenide, and the like and mixtures thereof are especially preferred because of their sensitivity to white light. Vanadyl phthalocyanine, metal free phthalocyanine and tellurium alloys are also preferred because these materials provide the additional benefit of being sensitive to infra-red light.

Any suitable polymeric film forming binder material may be employed as the matrix in the photogenerating layer. Typical polymeric film forming materials include those described, for example, in U.S. Pat. No. 3,121,006. The binder polymer should adhere well to the adhesive layer, dissolve in a solvent which also dissolves the upper surface of the adhesive layer and be miscible with the copolyester of the adhesive layer to form a polymer blend zone. Typical solvents include tetrahydrofuran, cyclohexanone, methylene chloride, 1,1,1-trichloroethane, 1,1,2-trichloroethane, trichloroethylene, toluene, and the like, and mixtures thereof. Mixtures of solvents may be utilized to control evaporation range. For example, satisfactory results may be achieved with a tetrahydrofuran to toluene ratio of between about 90:10 and about 10:90 by weight. Generally, the combination of photogenerating pigment, binder polymer and solvent should form uniform dispersions of the photogenerating pigment in the charge generating layer coating composition. Typical combinatons include polyvinylcarbazole, trigonal selenium and tetrahydrofuran; phenoxy resin, trigonal selenium and toluene; and polycarbonate resin, vanadyl phthalocyanine and methylene chloride. The solvent for the charge generating layer binder polymer should dissolve the polymer binder utilized in the charge generating layer and be capable of dispersing the photogenerating pigment particles present in the charge generating layer.

The photogenerating composition or pigment may be present in the resinous binder composition in various amounts. Generally, from about 5 percent by volume to about 90 percent by volume of the photogenerating pigment is dispersed in about 10 percent by volume to about 90 percent by volume of the resinous binder. Preferably from about 20 percent by volume to about 30 percent by volume of the photogenerating pigment is dispersed in about 70 percent by volume to about 80 percent by volume of the resinous binder composition. In one embodiment about 8 percent by volume of the photogenerating pigment is dispersed in about 92 percent by volume of the resinous binder composition.

The photogenerating layer generally ranges in thickness from about 0.1 micrometer to about 5.0 micrometers, preferably from about 0.3 micrometer to about 3 micrometers. The photogenerating layer thickness is related to binder content. Higher binder content compositions generally require thicker layers for photogeneration. Thicknesses outside these ranges can be selected providing the objectives of the present invention are achieved. Any suitable technique may be utilized to mix and thereafter apply the photogenerating layer coating mixture to the previously dried adhesive layer. Typical application techniques include spraying, dip coating, roll coating, wire wound rod coating, and the like. Drying of the deposited coating may be effected by any suitable technique such as oven drying, infrared radiation drying, air drying, vacuum drying, and the like, to remove substantially all of the solvents utilized in applying the coating.

The Active Charge Transport Layer

The active charge transport layer 7 may comprise any suitable transparent organic polymer or non-polymeric material capable of supporting the injection of photo-generated holes or electrons from the charge generating layer 6 and allowing the transport of these holes or electrons through the organic layer to selectively discharge the surface charge. The active charge transport layer not only serves to transport holes or electrons, but also protects the photoconductive layer from abrasion or chemical attack and therefore extends the operating life of the photoreceptor imaging member. The charge transport layer should exhibit negligible, if any, discharge when exposed to a wavelength of light useful in xerography, e.g. 4000 Angstroms to 9000 Angstroms. The charge transport layer is preferably substantially transparent to radiation in a region in which the photoconductor is to be used. It is comprised of a substantially non-photoconductive material which supports the injection of photogenerated holes or electrons from the charge generating layer. The active charge transport layer is normally transparent when exposure is effected therethrough to ensure that most of the incident radiation is utilized by the underlying charge generating layer. When used with a transparent substrate, imagewise exposure or erase may be accomplished through the substrate with all light passing through the substrate. In this case, the active charge transport material need not transmit light in the wavelength region of use. The charge transport layer in conjunction with the charge generating layer is an insulator to the extent that an electrostatic charge placed on the charge transport layer is not conducted in the absence of illumination.

The active charge transport layer may comprise activating compounds (charge transport molecules) dispersed in normally electrically inactive polymeric materials for making these materials electrically active. These charge transport molecules may be added to polymeric materials which are incapable of supporting the injection of photogenerated holes and incapable of allowing the transport of these holes. An especially preferred transport layer employed in multilayer photoconductors comprises from about 25 percent to about 75 percent or more by weight of at least one type of charge transporting aromatic amine, and about 75 percent to about 25 percent by weight of a polymeric film forming resin in which the aromatic amine is soluble.

The charge transport molecules are preferably at least one aromatic amine having the formula:

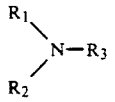

wherein $R_1$ and $R_2$ are each an aromatic group selected from the group consisting of a substituted or unsubstituted phenyl group, a naphthyl group, and a polyphenyl group, and $R_3$ is selected from the group consisting of a substituted or unsubstituted aryl group, an alkyl group having from 1 to 18 carbon atoms and a cycloaliphatic group having from 3 to 18 carbon atoms. The substituents should be free from electron withdrawing groups such as $NO_2$ groups, CN groups, and the like. Typical aromatic amine compounds that are represented by this structural formula include:

I. Triphenyl amines such as:

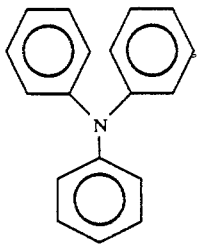

II. Bis and poly triarylamines such as:

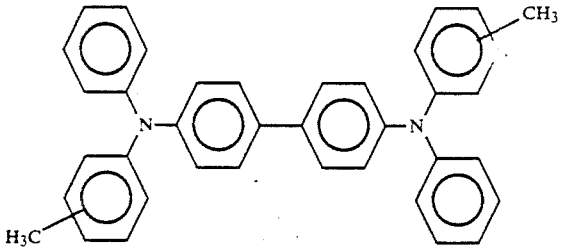

III. Bis arylamine ethers such as:

-continued

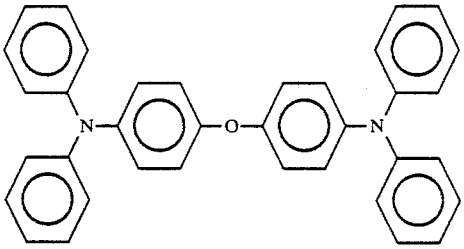

and

IV. Bis alkyl-arylamines such as:

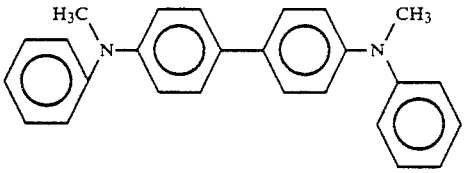

A preferred aromatic amine compound has the general formula:

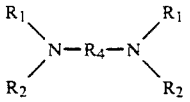

wherein $R_1$ and $R_2$ are defined above and $R_4$ is selected from the group consisting of a substituted or unsubstituted biphenyl group, a diphenyl ether group, an alkyl group having from 1 to 18 carbon atoms, and a cycloaliphatic group having from 3 to 12 carbon atoms. The substituents should be free from electron withdrawing groups such as $NO_2$ groups, CN groups, and the like. These compounds will hereinafter be referred to as triarylamines.

Examples of charge transporting aromatic amines represented by the structural formulae above include triphenylmethane, bis(4-diethylamino-2-methylphenyl)-phenylmethane; 4'-4''-bis(diethylamino)-2',2''-dimethyltriphenylmethane; N,N'-bis(alkyl-phenyl)-(1,1'-biphenyl)-4,4'-diamine wherein the alkyl is, for example, methyl, ethyl, propyl, n-butyl, etc., N,N'-diphenyl-N,N'-bis(3''-methylphenyl)-(1,1'biphenyl)-4,4'-diamine; and the like.

Any suitable inactive resin binder in which the charge transport molecules are soluble or may be molecularly dispersed, and which is soluble in methylene chloride or other suitable solvents may be employed. Typical inactive resin binders include polycarbonate resin, polyvinylcarbazole, polyester, polyester copolymers, polyarylate, polyacrylate, polystyrene, polyether, polysulfone, polyethersulfone, phenoxy resins, and the like alone and in blends. Molecular weights can vary from about 20,000 to about 1,500,000. Other solvents that may dissolve these binders include tetrahydrofuran, toluene, trichloroethylene, 1,1,2-trichloroethane, 1,1,1-trichloroethane, methyl ethyl ketone, and the like.

The preferred electrically inactive resin materials are bisphenol A polycarbonate resins having a molecular weight from about 20,000 to about 120,000, more preferably from about 50,000 to about 100,000. The materials most preferred as the electrically inactive resin material are poly(4,4'-dipropylidene-diphenylene carbonate)

with a molecular weight of from about 35,000 to about 40,000, available as Lexan 145 from General Electric Company; poly(4,4'-isopropylidene-diphenylene carbonate) with a molecular weight of from about 40,000 to about 45,000, available as Lexan 141 from General Electric Company; a polycarbonate resin having a molecular weight of from about 50,000 to about 100,000, available as Makrolon from Farbenfabricken Bayer A.G.; a polycarbonate resin having a molecular weight from about 20,000 to about 50,000 available as Merlon from Mobay Chemical Company; polyether carbonates; and 4,4'-cyclohexylidene diphenyl polycarbonate. Methylene chloride solvent is a desirable component of the charge transport layer coating mixture for adequate dissolving of all the components and for its low boiling point.

An especially preferred multilayered photoconductor comprises a charge generating layer comprising a binder layer of photoconductive material and a contiguous hole transport layer of a polycarbonate resin material having a molecular weight of from about 20,000 to about 120,000 having dispersed therein from about 25 to about 75 percent by weight of one or more compounds having the general formula:

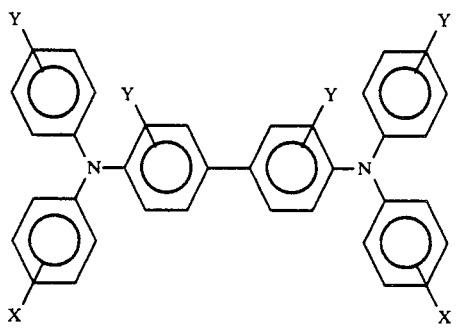

wherein X is selected from the group consisting of an alkyl group, having from 1 to about 4 carbon atoms, and Y is H or an alkyl group having 1–4 carbon atoms. The photoconductive layer should exhibit the capability of photogeneration of holes and injection of the holes, the hole transport layer being substantially non-absorbing in the spectral region at which the photoconductive layer generates and injects photogenerated holes but being capable of supporting the injection of photogenerated holes from the photoconductive layer and transporting the holes through the hole transport layer.

According to the invention, the PDMS copolymers may be incorporated into the charge transport layer. The PDMS copolymers should be compatible with both the resin binder and the charge transport molecules of the charge transport layer. They should also be soluble in solvents such as methylene chloride which dissolve these materials. The PDMS copolymer is selected to ensure that it is dissolved or very highly dispersed (preferably at a molecular level) in the binder to prevent undue phase separation. For example, for a bisphenol polycarbonate binder, a PDMS bisphenol copolymer such as PDMS cobisphenol A or C block copolymer may be used. As another example, for a polystyrene binder, a PDMS polystyrene block copolymer may be used. For a polyurethane binder, a PDMS polyurethane block copolymer may be used.

A relatively low degree of phase separation may be acceptable where the copolymer has a lower molecular weight than the binder. In this case, the copolymer may tend to shift upward toward the surface of the charge transport layer, thus enhancing the desired surface effects.

The PDMS copolymer should be present in the charge transport layer in an amount less than about 50% by weight of the binder to prevent undue phase separation. It is preferably present in an amount of about 1 to about 50% by weight, more preferably 1 to about 20% by weight of the binder.

The thickness of the charge transport layer may range from about 10 micrometers to about 50 micrometers, and preferably from about 20 micrometers to about 35 micrometers. Optimum thicknesses may range from about 23 micrometers to about 31 micrometers.

The Ground Strip

The ground strip may comprise a film forming polymer binder and electrically conductive particles. Any suitable electrically conductive particles may be used in the electrically conductive ground strip layer 9. The ground strip 9 may comprise materials which include those enumerated in U.S. Pat. No. 4,664,995. Typical electrically conductive particles include carbon black, graphite, copper, silver, gold, nickel, tantalum, chromium, zirconium, vanadium, niobium, indium tin oxide and the like. The electrically conductive particles may have any suitable shape. Typical shapes include irregular, granular, spherical, elliptical, cubic, flake, filament, and the like. Preferably, the electrically conductive particles should have a particle size less than the thickness of the electrically conductive ground strip layer to avoid an electrically conductive ground strip layer having an excessively irregular outer surface. An average particle size of less than about 10 micrometers generally avoids excessive protrusion of the electrically conductive particles at the outer surface of the dried ground strip layer and ensures relatively uniform dispersion of the particles throughout the matrix of the dried ground strip layer. The concentration of the conductive particles to be used in the ground strip depends on factors such as the conductivity of the specific conductive particles utilized.

The ground strip layer may have a thickness from about 7 micrometers to about 42 micrometers, and preferably from about 14 micrometers to about 27 micrometers.

The Anti-Curl Layer

The anti-curl layer 1 may comprise organic polymers or inorganic polymers that are electrically insulating or slightly semi-conductive. The anti-curl layer provides flatness and/or abrasion resistance.

Anti-curl layer 1 may be formed at the back side of the substrate 2, opposite to the imaging layers. The anti-curl layer may comprise a film forming resin binder and an adhesion promoter additive. The resin binder may be the same resins as the resin binders of the charge transport layer discussed above. Examples of film forming resins include polyacrylate, polystyrene, bisphenol polycarbonate, poly(4,4'-isopropylidene diphenyl carbonate), 4,4'-cyclohexylidene diphenyl polycarbonate, and the like. Typical adhesion promoters used as additives include 49,000 (du Pont), Vitel PE-100, Vitel PE-200, Vitel PE-307 (Goodyear), and the like. Usually from about 1 to about 15 weight percent adhesion promoter is selected for film forming resin addition. The thickness of the anti-curl layer is from about 3 micrometers to about 35 micrometers, and preferably about 14 micrometers.

According to the invention, the PDMS copolymers may be incorporated into the anti-curl layer. The PDMS copolymers should be compatible with the film forming resin of the anti-curl layer. They should also be soluble in solvents such as methylene chloride which dissolve these resins. The PDMS copolymer is selected to ensure that it is dissolved or very highly dispersed (preferably at a molecular level) in the binder to prevent undue phase separation. For example, for a bisphenol polycarbonate binder, a PDMS bisphenol copolymer such as PDMS cobisphenol A or C block copolymer may be used. As another example, for a polystyrene binder a PDMS polystyrene block copolymer may be used. For a polyurethane binder, a PDMS polyurethane block copolymer may be used.

The PDMS copolymer should be present in the anti-curl layer in an amount less than about 50% by weight of the binder to prevent undue phase separation. It is preferably present in an amount of about 1 to about 50% by weight, more preferably 1 to about 20% by weight, of the binder.

The Overcoating Layer

The optional overcoating layer 8 (not present when the invention is applied to the charge transport layer) may comprise organic polymers or inorganic polymers that are electrically insulating or slightly semi-conductive. The overcoating layer may range in thickness from about 2 micrometers to about 8 micrometers, and preferably from about 3 micrometers to about 6 micrometers An optimum range of thickness is from about 3 micrometers to about 5 micrometers.

The invention is not limited to use in the above-described imaging members. For example, imaging members of the type described in U.S. Pat. No. 4,515,882 (hereby incorporated by reference) may incorporate the invention. Such an imaging member may include at least one photoconductive layer and an overcoating layer in which charge transport molecules and finely divided charge injection enabling particles are dispersed in a film-forming continuous phase. (The term charge transport layer may be used herein such as to encompass such an overcoating layer.) PDMS copolymers may be incorporated in such an overcoating (charge transport) layer according to the invention.

The invention will further be illustrated in the following, non-limitative examples, it being understood that these examples are intended to be illustrative only and that the invention is not intended to be limited to the materials, conditions, process parameters and the like recited herein.

EXAMPLE I

A photoconductive imaging member is prepared by providing a titanium coated polyester. (Melinex available from ICI Americas Inc.) substrate having a thickness of 3 mils, and applying thereto, using a gravure applicator, a solution containing 50 grams 3-aminopropyltriethoxysilane, 15 grams acetic acid, 684.8 grams of 200 proof denatured alcohol and 200 grams heptane. This layer is then dried for 10 minutes at 135° C. in a forced air oven. The resulting hole blocking layer has a dry thickness of 0.05 micrometer.

An adhesive interface layer is then prepared by applying a wet coating over the hole blocking layer, using a gravure applicator, containing 0.5 percent by weight based on the total weight of the solution of copolyester adhesive (DuPont 49,000, available from E. I. du Pont de Nemours & Co.) in a 70:30 volume ratio mixture of tetrahydrofuran/cyclohexanone. The adhesive interface layer is then dried for 10 minutes at 135° C. in a forced air oven. The resulting adhesive interface layer has a dry thickness of 0.05 micrometer.

The adhesive interface layer is thereafter coated with a photogenerating layer containing 7.5 percent by volume trigonal selenium, 25 percent by volume N,N'-diphenyl-N,N'-bis(3-methylphenyl)-1,1'-biphenyl-4,4'-diamine, and 67.5 percent by volume polyvinylcarbazole. This photogenerating layer is prepared by introducing 80 grams polyvinylcarbazole to 1400 ml of a 1:1 volume ratio of a mixture of tetrahydrofuran and toluene. To this solution are added 80 grams of trigonal selenium and 10,000 grams of ⅛ inch diameter stainless steel shot. This mixture is then placed on a ball mill for 72 to 96 hours. Subsequently, 500 grams of the resulting slurry are added to a solution of 36 grams of polyvinylcarbazole and 20 grams of N,N'-diphenyl-N,N'-bis(3-methylphenyl)-1,1'-biphenyl-4,4'-diamine in 750 ml of 1:1 volume ratio of tetrahydrofuran/toluene. This slurry is thereafter applied to the adhesive interface with an extrusion die to form a layer having a wet thickness of about 0.5 mil. However, a strip about 3 mm wide along one edge of the substrate, blocking layer and adhesive layer is deliberately left uncoated by any of the photogenerating layer material to facilitate adequate electrical contact by the ground stirp layer that is applied later. This photogenerating layer is dried at 135° C. for 5 minutes in a forced air oven to form a photogenerating layer having a dry thickness of 2.3 micrometers.

This member is then coated with a charge transport layer which is prepared by introducing into an amber glass bottle in a weight ratio of 1:1 N,N'-diphenyl-N,N'-bis(3-methylphenyl)-1,1'-biphenyl-4,4'-diamine and Makrolon 5705, a polycarbonate resin having a molecule weight of from about 50,000 to 100,000 commercially available from Farbenfabricken Bayer A.G. The resulting mixture is dissolved in methylene chloride to provide a 15 weight percent solution thereof. This solution is applied on the photogenerator layer by extrusion to form a coating which upon drying has a thickness of 24 micrometers. During this coating process the relative humidity is maintained at about 14 percent. The resulting photoconductive member is then annealed at 135° in a forced air oven for 5 minutes.

EXAMPLE II

A photoconductive imaging member is prepared by following the same procedures as described in the EXAMPLE I except that a charge transport layer is added with PDMS bisphenol A block copolymer of the present invention. The resulting dry charge transport layer is 24 micrometers thick and has a weight ratio of 1:0.95:0.05 N,N'-diphenyl-N,N'-bis(3-methylphenyl)-1,1'-biphenyl-4,4'diamine: Makrolon 5705 (available from Bayer AG): PDMS bisphenol A block copolymer (available from Petrarch System, Inc ).

EXAMPLE III

The photoconductive imaging members of Examples I and II were tested for tensile cracking strain, 180° peel strength, and coefficient of friction. Tensile cracking strain is determined by cutting several 1.27 cm × 10.16 cm imaging member samples, inserting one sample into the jaws of an Instron Tensile Tester using a 5.08 cm gauge, and pulling the sample to 3% strain with a 5.1 mm/min crosshead speed. The tested sample is then removed from the Instron Tensile Tester and examined for charge transport layer cracking under a reflection optical microscope at 100 times magnification. If charge transport layer cracking does not occur, a fresh sample is tested following the same procedures, but at an increased incremental strain 0.25% higher than the previous one. The tensile strain testing is repeated, each time with a fresh sample, until charge transport layer cracking becomes evident. The strain at which the cracking occurs is recorded as the charge transport layer's tensile cracking strain. The results obtained are given in the following Table I.

TABLE I

| Example | Cracking Strain (%) |
|---|---|
| I (Control) | 3.25 |
| II | 3.75 |

It is obvious that the resistance of a charge transport layer against tensile stress cracking is improved even with only 2½% by weight of block copolymer incorporation.

The coefficient of friction test is conducted by fastening the photoconductive imaging member of Example I, with its charge transport layer (having no block copolymer addition) facing up, to a platform surface. A polyurethane cleaning blade is then secured to the flat surface of the bottom of a horizontally sliding plate weighing 200 grams. The sliding plate is dragged in a straight line over the platform, against the horizontal test sample surface, with the surface of the blade facing downward. The sliding plate is moved by a cable which has one end attached to the plate and the other end threaded around a low friction pulley and fastened to the Instron Tensile Tester. The pulley is positioned so that the segment of the cable between the weight and the pulley is parallel to the surface of the flat horizontal test surface. The cable is pulled vertically upward from the pulley by the Instron Tensile Tester. The coefficient of friction test for the charge transport layer against the cleaning blade is repeated again as described but the photoconductive imaging member of Example I is replaced with the invention imaging sample of Example II having 2½% by weight PDMS bisphenol A block copolymer in the charge transport layer. The coefficient of friction is calculated by dividing the load by 200 grams.

The results presented in Table II below show the effectiveness of the present invention in lowering the charge transport layer/blade frictional interaction. These results reflect a 100% surface contact friction reduction. Since reduction in surface contact friction will result in reduction in frictional force between two sliding surfaces, it should enhance the charge transport layer's wear resistance as well.

As shown in Table II, incorporation of block copolymer produces no negative impact on the peel strength of the charge transport layer.

TABLE II

| Example | 180° peel strength (gm/cm) | Static coefficient of friction |
|---|---|---|
| I (Control) | 98.5 | 3.8 |
| II | 99.1 | 1.9 |

It is also important to note that PDMS bisphenol A block copolymer incorporation does not alter the optical transmittancy of the charge transport layer of the invention imaging member of EXAMPLE II. Good optical clarity of the charge transport layer is essential to maintain good print quality in the copy.

EXAMPLE IV

The electrical properties of the photoconductive imaging samples prepared according to EXAMPLES I and II are evaluated with a xerographic testing scanner comprising a cylindrical aluminum drum having a diameter of 9.55 inches. The test samples are taped onto the drum. When set to rotation, the drum which carries the samples produces a constant surface speed of 30 inches per second. A direct current pin corotron, exposure light, erase light, and five electrometer probes are mounted around the periphery of the mounted photoreceptor samples. The sample charging time is 33 milliseconds. Both exposed and erase light are broad band white light (400–700 nm) outputs, each supplied by a 300 watt output Xerox arc lamp. The relative locations of the probes and lights are indicated in Table III below:

TABLE III

| ELEMENT | ANGLE DISTANCE FROM (Degrees) | ANGLE DISTANCE FROM POSITION | PHOTORECEPTOR |
|---|---|---|---|
| CHARGE | 0 | 0 | 18 mm (Pine)<br>12 mm (Shield) |
| Probe 1 | 22.50 | 47.9 mm | 3.17 mm |
| Expose | 56.25 | 118.8 | N.A. |
| Probe 2 | 78.75 | 166.8 | 3.17 mm |
| Probe 3 | 168.75 | 356.0 | 3.17 mm |
| Probe 4 | 236.25 | 489.0 | 3.17 mm |
| Erase | 258.75 | 548.0 | 125 mm |
| Probe 5 | 303.75 | 642.9 | 3.17 mm |

The test samples are first rested in the dark for at least 60 minutes to ensure achievement of equilibrium with the testing conditions at 40% relative humidity and 21° C. Each sample is then negatively charged in the dark to a development potential of about 900 volts. The charge acceptance of each sample and its residual potential after discharge by front erase exposure to 400 ergs/cm$^2$ of light exposure are recorded. The test procedure is repeated to determine the photo induced discharge characteristic of each sample by different light energies of up to 20 ergs/cm$^2$.

10,000 cycles electric results obtained for the test samples in both EXAMPLES I and II give equivalent dark decay potential, background voltage, the extent of electrical cycle down after 10,000 cycles of testing, and photo-induced discharge characteristic curves. These electrical cyclic results are of particular importance because they indicate that incorporation of PDMS bisphenol A block copolymer in the charge transport layer of the present invention not only improves the desired mechanical and frictional properties of the charge transport layer, but that the crucial electrical integrity of the photoconductive imaging member is also maintained.

While the invention has been described with reference to particular preferred embodiments, the invention is not limited to the specific examples given, and other embodiments and modifications can be made by those skilled in the art without departing from the spirit and scope of the invention.

What is claimed is:

1. An electrophotographic imaging member, comprising at least one exposed layer which contains a polydimethylsiloxane copolymer and a film forming resin binder, the polydimethylsiloxane copolymer being present in an amount to prevent undue phase separation, said layer being selected from the group consisting of a charge transport layer and an anti-curl layer.

2. The imaging member of claim 1, wherein said exposed layer contains about 1 to about 50 parts by weight of said copolymer and about 99 to about 50 parts by weight of said film forming resin binder.

3. The imaging member of claim 1, wherein said exposed layer is a charge transport layer containing said copolymer, said film forming resin binder and charge transport molecules.

4. The imaging member of claim 3, wherein said copolymer is a block copolymer of first blocks and second blocks, said first blocks being polydimethylsiloxane and said second blocks being selected from the group consisting of bisphenols, polystyrenes, polyethersulfones, and polyurethanes.

5. The imaging member of claim 3, wherein said copolymer is polydimethylsiloxane cobisphenol A block copolymer, said film forming resin binder is bisphenol A polycarbonate, and said charge transport molecules are aromatic amines.

6. The imaging member of claim 5, wherein said aromatic amines are of the formula

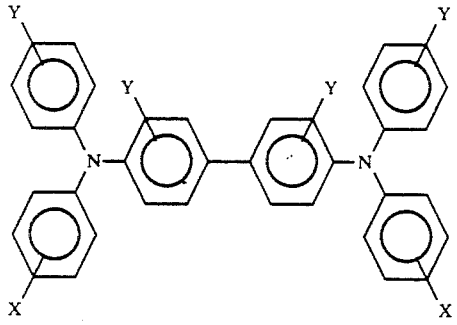

wherein X is an alkyl group having 1 to about 4 carbon atoms and Y is H or an alkyl group having 1 to about 4 carbon atoms.

7. The imaging member of claim 5, wherein said copolymer is present in an amount of about 1 to about 10% by weight of binder.

8. The imaging member of claim 3, wherein said copolymer is polydimethylsiloxane polystyrene block copolymer, said film forming resin binder is polystyrene, and said charge transport molecules are aromatic amines.

9. The imaging member of claim 8, wherein said aromatic amines are of the formula

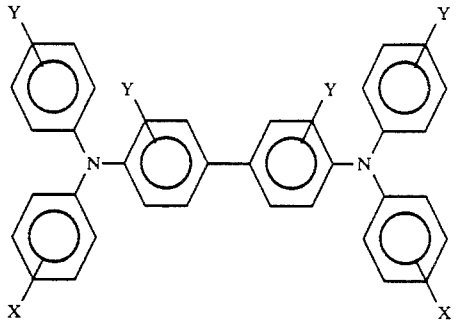

wherein X is an alkyl group having 1 to about 4 carbon atoms and Y is H or an alkyl group having 1 to about 4 carbon atoms.

10. The imaging member of claim 8, wherein said copolymer is present in an amount of about 40 to about 50% by weight of binder.

11. The imaging member of claim 1, wherein said exposed layer is an anti-curl layer.

12. The imaging member of claim 11, wherein said film forming resin binder is selected from the group consisting of polystyrene, bisphenol polycarbonate and polyurethane and said copolymer is selected from corresponding members of the group consisting of polydimethylsiloxane cobisphenol A, polydimethylsiloxane cobisphenol C, polydimethylsiloxane copolystyrene and polydimethylsiloxane copolyurethane.

13. The imaging member of claim 11, wherein said film forming resin binder is bisphenol polycarbonate and said copolymer is one of PDMS cobisphenol A and PDMS cobisphenol C.

14. An electrophotographic imaging member comprising:

a substrate layer;

a charge generating layer; and a charge transport layer which contains about 99 to about 50 parts by weight of an inactive film forming resin binder, about 1 to about 50 parts by

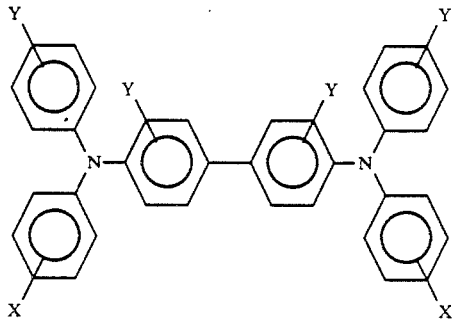

weight of a polydimethylsiloxane copolymer, and charge transport molecules.

15. The imaging member of claim 14, wherein said copolymer is polydimethylsiloxane cobisphenol A block copolymer, said resin binder is bisphenol A polycarbonate, and said charge transport molecules are aromatic amines.

16. The imaging member of claim 15, wherein said aromatic amines are of the formula wherein X is an alkyl group having 1 to about 4 carbon atoms and Y is H or an alkyl group having 1 to about 4 carbon atoms.

17. The imaging member of claim 16, wherein said copolymer is present in an amount of about 5% by weight of said film forming binder.

18. An electrophotographic imaging member comprising:

a substrate having a conductive layer;

a charge blocking layer;

an adhesive layer;

a charge generating layer; and a charge transport layer which contains a weight ratio of 1:0.95:0.05 of aromatic amine:polycarbonate resin:PDMS bisphenol A block copolymer.

* * * * *